US008258089B2

(12) United States Patent
Fujinami et al.

(10) Patent No.: US 8,258,089 B2
(45) Date of Patent: Sep. 4, 2012

(54) GREASE COMPOSITION

(75) Inventors: Yukitoshi Fujinami, Chiba (JP); Hideto Kamimura, Chiba (JP)

(73) Assignee: Idemitsu Kosan Co., Ltd., Tokyo (JP)

( * ) Notice: Subject to any disclaimer, the term of this patent is extended or adjusted under 35 U.S.C. 154(b) by 241 days.

(21) Appl. No.: 11/910,941

(22) PCT Filed: Apr. 5, 2006

(86) PCT No.: PCT/JP2006/307235

§ 371 (c)(1),
(2), (4) Date: Oct. 8, 2007

(87) PCT Pub. No.: WO2006/109652

PCT Pub. Date: Oct. 19, 2006

(65) Prior Publication Data

US 2009/0281008 A1 Nov. 12, 2009

(30) Foreign Application Priority Data

Apr. 8, 2005 (JP) ..... 2005-112597

(51) Int. Cl.

| | |
|---|---|
| ***C10M 141/10*** | (2006.01) |
| ***C10M 141/06*** | (2006.01) |
| ***C10M 169/02*** | (2006.01) |
| ***C10M 169/06*** | (2006.01) |

(52) U.S. Cl. ..... 508/421; 508/262; 508/244; 508/283; 508/268; 508/302

(58) Field of Classification Search ..... 508/262, 508/244, 283, 268, 302, 421
See application file for complete search history.

(56) References Cited

U.S. PATENT DOCUMENTS

| | | | | |
|---|---|---|---|---|
| 3,725,279 | A * | 4/1973 | Armstrong | 508/552 |
| 4,473,377 | A * | 9/1984 | Horodysky et al. | 44/405 |
| 5,641,841 | A * | 6/1997 | Diaz et al. | 525/540 |
| 5,773,394 | A * | 6/1998 | Wan et al. | 508/591 |
| 5,827,602 | A * | 10/1998 | Koch et al. | 429/328 |
| 5,846,918 | A * | 12/1998 | Meijer et al. | 508/591 |
| 2002/0015883 | A1* | 2/2002 | Hilarius et al. | 429/188 |
| 2002/0015884 | A1* | 2/2002 | Schmidt et al. | 429/188 |
| 2004/0094741 | A1* | 5/2004 | Sato et al. | 252/1 |
| 2004/0179758 | A1* | 9/2004 | Ohno | 384/100 |
| 2007/0027038 | A1* | 2/2007 | Kamimura et al. | 508/244 |

FOREIGN PATENT DOCUMENTS

| | | | |
|---|---|---|---|
| JP | 2002-187893 | | 7/2002 |
| JP | 2005-507003 | | 3/2005 |
| JP | 2005089667 | A * | 4/2005 |
| JP | 2005-154755 | | 6/2005 |
| JP | 2005-336309 | | 12/2005 |
| JP | 2006-249368 | | 9/2006 |
| WO | 2005/035702 | | 4/2005 |

OTHER PUBLICATIONS

Friction and Wear Behaviors of Ionic Liquid of Alkylimidizolium Hexafluorophoshpates as Lubricnats for Steel/Steel Contact by Wan, Lu, Ye, Liu and Ciu (Wear 256 (2004) 44-48).*

A new type of polymer gel electrolyte: Zwitterionic liquid/polar polymer mixture by Ohno, Yohizawa, and Wataru, Electrochimica Acta 48 (2003) 2079-2083.*

U.S. Appl. No. 11/913,182, filed Oct. 31, 2007, Kamimura et al.

Reich, Ronald A. et al., "Base Oil Properties of Ionic Liquids", Lubrication Engineering, vol. 59, No. 7, pp. 16-21, 2003.

Office Action issued on Novermber 24, 2010 in the corresponding Japanese Application No. 2005-112597, filed Apr. 8, 2005 (English translation only). The Office Action was filed Sep. 22, 2011 in the Japanese language only.

* cited by examiner

*Primary Examiner* — Cephia D Toomer
*Assistant Examiner* — Pamela H Weiss
(74) *Attorney, Agent, or Firm* — Oblon, Spivak, McClelland, Maier & Neustadt, L.L.P.

(57) ABSTRACT

Provided is a grease composition with a long service life under high-temperature conditions, considerable low-evaporability, and incombustibility.

The invention provides a grease composition comprising, as a base oil, an ionic liquid formed of a cation and an anion and having an ion concentration of 1 mol/dm$^3$ or more as measured at 20° C., and a thickener, wherein the grease composition has a dropping point of 260° C. or higher.

25 Claims, No Drawings

GREASE COMPOSITION

TECHNICAL FIELD

The present invention relates to a grease composition and, more particularly, to a grease composition which can be used at high temperature for a long period of time and which is low-evaporative and incombustible.

BACKGROUND ART

Due to recent mechanical advances and keen attention paid to maintenance-free benefits, lubrication by means of grease is required to be performed under more and more severe conditions. Thus, use of a grease composition which is stable particularly under high-temperature conditions for a long period of time is a key to prolong of service life of machines. Therefore, there is demand for enhancing performance of such a grease composition.

In electronic parts and devices which have been remarkably developed in recent years as well as in production facilities therefor, contamination of grease decomposition products is problematic. Therefore, there is also demand for low-evaporative grease compositions.

Grease compositions exhibiting a long service life under high-temperature conditions which have heretofore been proposed include a grease comprising a trimellitate ester as a base oil (see, for example, Patent Documents 1 to 3) and a grease comprising alkylated diphenyl ether as a base oil (see, for example, Patent Document 4). In addition, greases comprising methylsilicone or methylphenylsilicone as a base oil, greases comprising perfluoroalkyl polyether (hereinafter referred to as "PFAE") as a base oil, and other grease products have also been proposed. Among them, grease products comprising PFAE as a base oil, which exhibit a long service life under high-temperature conditions, are generally employed in an atmosphere of a temperature higher than 200° C.

However, when grease products comprising PFAE as a base oil are employed under higher-temperature conditions, fluoro-oil contained in the products is decomposed, which limits use of the grease products under such high-temperature conditions. Therefore, at present, grease replenishment intervals or exchange cycles of lubricated parts are shortened.

Among grease compositions exhibiting a long service life under the aforementioned high-temperature conditions, a grease product comprising PFAE as a base oil has resistance to decomposition up to a certain high temperature. Thus, such a PFAE-comprising grease product is effectively employed as a low-evaporative grease. However, performance of such a grease is still unsatisfactory, and there is also demand for a grease composition which is low-evaporative under higher-temperature conditions.

Although most grease compositions are classified as a non-hazardous substance by the fire services law, a grease composition comprising a base oil originating predominantly from carbon, hydrogen, and oxygen is combusted when used in environments which allow direct contact with fire or used along with high-temperature metallic material. When a grease comprising PFAE—incombustible base oil—is used under such conditions, toxic gas may be generated through decomposition of the grease at high temperature. A grease comprising silicone oil as a base oil does not cause such a problem, but provides reduced lubricity under boundary lubrication conditions, which is problematic.

[Patent Document 1]
Japanese Patent Publication (kokoku) No. 7-45677
[Patent Document 2]
Japanese Patent Application Laid-Open (kokai) No. 11-131082
[Patent Document 3]
Japanese Patent Application Laid-Open (kokai) No. 7-109480
[Patent Document 4]
Japanese Patent Application Laid-Open (kokai) No. 3-28299

DISCLOSURE OF THE INVENTION

The present invention has been made under the above-described circumstances. Thus, an object of the present invention is to provide a grease composition with a long service life under high-temperature conditions, considerable low-evaporability, and incombustiblility.

In an attempt to attain the aforementioned object, the present inventors have carried out extensive studies, and have found that the object can be attained by combination of an ionic fluid having a specific structure and a specific thickener. The present invention has been accomplished on the basis of this finding.

Accordingly, the present invention provides a grease composition comprising, as a base oil, an ionic liquid which is formed of a cation and an anion and having an ion concentration of 1 mol/dm$^3$ or more as measured at 20° C., and a thickener, wherein the grease composition has a dropping point of 260° C. or higher.

According to the present invention, there can be provided a grease composition which exhibits a long service life when used under high-temperature conditions, particularly at 250° C. or higher, which is considerably low-evaporative, and which is incombustible.

BEST MODES FOR CARRYING OUT THE INVENTION

The grease composition of the present invention comprises, as a base oil, an ionic liquid which is formed of a cation and an anion and having an ion concentration of 1 mol/dm$^3$ or more as measured at 20° C. In order to attain strong ionic atmosphere and electrostatic interaction from sole cations and anions without employing water or other solvents, the ion concentration is required to be 1 mol/dm$^3$ or more, preferably 1.5 mol/dm$^3$ or more, more preferably 2 mol/dm$^3$ or more. As used herein, the concept "ion concentration" refers to a value calculated from the following relationship:

$$[\text{density of ionic liquid (g/cm}^3\text{)/molecular weight (MW) of ionic liquid (g/mol)}]\times 1000.$$

Preferably, the grease composition of the present invention comprises an ionic liquid having a total acid number of 1 mgKOH/g or less as a base oil in an amount of 10 to 100% by mass. The ionic liquid which may be employed is represented by the following general formula:

$$(Z^{p+})_k(A^{q-})_m$$

(wherein $Z^{p+}$ represents a cation; $A^{q-}$ represents an anion; each of p, q, k, m, p×k, and q×m is an integer of 1 to 3, with the relationship p×k=q×m being satisfied; and, when k or m is 2 or more, a plurality of Zs or a plurality of As may be identical to or different from each other). In the present invention, p, q, k, or m in the above general formula is preferably 2 or less. More preferably, the grease composition comprises an ionic liquid represented by the general formula $Z^+A^-$ (wherein $Z^+$ represents a cation and $A^-$ represents an anion); i.e., the case in which p, q, k, and m are 1 in the above general formula, in an amount of 10 to % by mass. The grease composition of the present invention preferably has an ionic liquid content of 50 to 100% by mass, more preferably 70 to 100% by mass, particularly preferably 90 to 100% by mass.

The aforementioned cation ($Z^+$) is preferably represented by any of the following general formulae:

[F1]

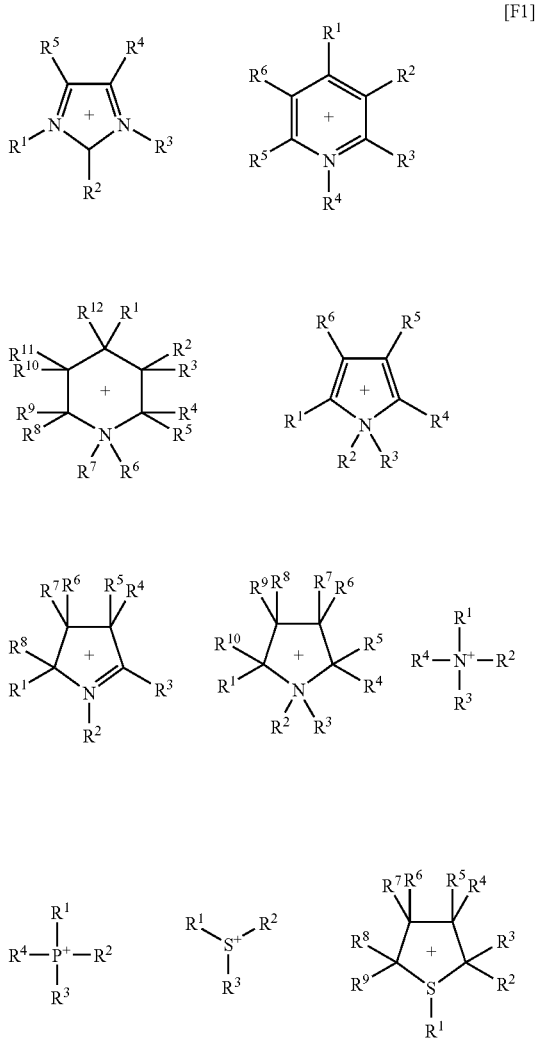

(wherein each of $R^1$ to $R^{12}$, which may be identical to or different from one another, represents a group selected from among a hydrogen atom, alkyl groups having carbon atoms of 1 to 18 which may each have an ether bond, and alkoxyl groups having carbon atoms of 1 to 18).

Examples of the alkyl groups having carbon atoms of 1 to 18 which may have an ether bond present as any of $R^1$ to $R^{12}$ include methyl, ethyl, n-propyl, isopropyl, n-butyl, isobutyl, sec-butyl, tert-butyl, pentyl groups, hexyl groups, heptyl groups, octyl groups, and 2-methoxyethyl. Examples of the alkoxy group having carbon atoms of 1 to 18 include methoxy, ethoxy, n-propoxy, isopropoxy, n-butoxy, isobutoxy, sec-butoxy, tert-butoxy, pentoxy groups, heptoxy groups, and octoxy groups. In the present invention, alkyl groups having carbon atoms of 1 to 10 are preferred.

Among the aforementioned cations ($Z^+$), the following members are more preferred:

[F2]

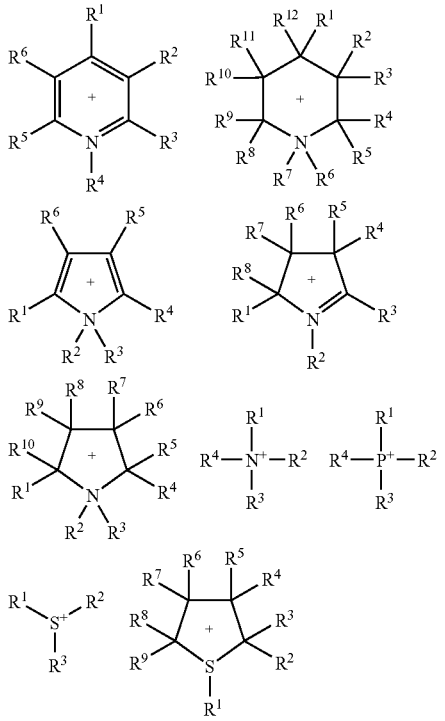

(wherein $R^1$ to $R^{12}$ have the same meanings as defined above).

Examples of preferred anions ($A^-$) include $BF_4^-$, $PF_6^-$, $C_nH_{(2n+1)}OSO_3^-$, $(C_nF_{(2n+1-x)}H_x)SO_3^-$, $(C_nF_{(2n+1-x)}H_x)COO^-$, $NO_3^-$, $CH_3SO_3^-$, $(CN)_2N^-$, $HSO_3^-$, $C_6H_5SO_3^-$, $CH_3(C_6H_4)SO_3^-$, $I^-$, $I_3^-$, $F(HF)_n^-$, $((C_nF_{(2n+1-x)}H_x)Y^1O_z)_3C^-$, $((C_nF_{(2n+1-x)}H_x)Y^1O_z)_2N^-$ (wherein $Y^1$ represents a carbon atom or a sulfur atom; when a plurality of $Y^1$s are present, these may be identical to or different from one another; a plurality of $(C_nF_{(2n+1-x)}H_x)Y^1O_z$ groups may be identical to or different from one another); n is an integer of 1 to 6; x is an integer of 0 to 13; and z is an integer of 1 to 3 when $Y^1$ is a carbon atom and of 0 to 4 when $Y^1$ is a sulfur atom), $B(C_mY^2_{(2m+1)})_4^-$, $P(C_mY^2_{(2m+1)})_6^-$ (wherein $Y^2$ is a hydrogen atom or a fluorine atom; when a plurality of $Y^2$s are present, these may be identical to or different from one another; a plurality of $(C_mY^2_{(2m+1)})$ groups may be identical to or different from one another); and m is an integer of 0 to 6), and anions represented by the following general formula:

[F3]

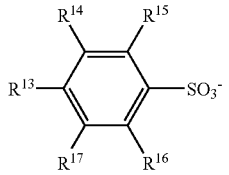

(wherein each of $R^{13}$ to $R^{17}$, which may be identical to or different from one another, represents a group selected from a hydrogen atom and $(C_nF_{(2n+1-x)}H_x)$; and n and x have the same meanings as defined above). Of these, anions comprising a fluorine atom are particularly preferred.

Among the aforementioned anions ($A^-$), more preferred anions are $PF_6^-$, $C_nH_{(2n+1)}OSO_3^-$, $(C_nF_{(2n+1-x)}H_x)SO_3^-$, $(C_nF_{(2n+1-x)}H_x)COO^-$, $NO_3^-$, $CH_3SO_3^-$, $(CN)_2N^-$, $HSO_3^-$, $((C_nF_{(2n+1-x)}H_x)Y^1O_z)_2N^-$ (wherein $Y^1$ represents a carbon atom or a sulfur atom; when a plurality of $Y^1$s are present, these may be identical to or different from one another; n is an integer of 1 to 6; x is an integer of 0 to 13; and z is an integer of 1 to 3 when $Y^1$ is a carbon atom and of 0 to 4 when $Y^1$ is a sulfur atom), and anions represented by the above general formula. Particularly preferred anions are $C_nH_{(2n+1)}OSO_3^-$, $(C_nF_{(2n+1-x)}H_x)SO_3^-$, $(C_nF_{(2n+1-x)}H_x)COO^-$, $NO_3^-$, $CH_3SO_3^-$, $(CN)_2N^-$, $HSO_3^-$, (wherein n is an integer of 1 to 6; and x is an integer of 0 to 13), and anions represented by the above.

Examples of the ionic liquid represented by the general formula $(Z^{p+})_k(A^{q-})_m$ serving as a base oil include those represented by the following general formula:

[F4]

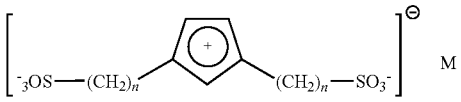

(wherein M represents a cation selected from among $H^+$, $Li^+$, $Na^+$, $K^+$, $Pb^+$, and $Cs^+$; and n is an integer of 0 to 18).

Specific examples of the ionic liquid represented by the general formula $Z^+A^-$ serving as a base oil include 1-butyl-3-methylimidazolium tetrafluoroborate, 1-butyl-3-methylimidazolium hexafluoroborate, 1-hexyl-3-methylimidazolium hexafluorophosphate, 1-butyl-3-methylimidazolium bis(trifluoromethanesulfonyl)imide, alkylpyridinium tetrafluoroborate, alkylpyridinium hexafluorophosphate, alkylpyridinium bis(trifluoromethanesulfonyl)imide, alkylammonium tetrafluoroborate, alkylammonium hexafluorophosphate, alkylammonium bis(trifluoromethanesulfonyl)imide, N,N-diethyl-N-methyl(2-methoxyethyl)ammonium tetrafluoroborate, N,N-diethyl-N-methyl(2-methoxyethyl)ammonium hexafluorophosphate, and N,N-diethyl-N-methyl(2-methoxyethyl)ammonium bis(trifluoromethanesulfonyl)imide. These ionic liquid species may be used singly or in combination of two or more members. In the case where an ionic liquid species having a total acid number higher than 1 mgKOH/g is employed, two or more ionic liquid species are used in combination so as to regulate the total acid number to 1 mgKOH/g or less.

In the present invention, preferred ionic liquid species are alkylpyridinium hexafluorophosphate, alkylpyridinium bis(trifluoromethanesulfonyl)imide, alkylammonium hexafluorophosphate, alkylammonium bis(trifluoromethanesulfonyl)imide, N,N-diethyl-N-methyl(2-methoxyethyl)ammonium hexafluorophosphate, and N,N-diethyl-N-methyl(2-methoxyethyl)ammonium bis(trifluoromethanesulfonyl)imide.

Through employment of two or more ionic liquid species serving as a base oil, a grease composition having remarkably improved physical characteristics (viscosity index, pour point, etc.) can be produced. In this case, these member may be mixed at arbitrary proportions. From the viewpoint of attaining a mixing effect, each ionic liquid species content is preferably adjusted to 10% by mass or more based on the mixture. For example, the mixture comprises one $Z^+$ member and two or more $A^-$ members, two or more $Z^+$ members and one $A^-$ member, or two or more $Z^+$ members and two or more $A^-$ members.

Specific examples of the mixture include a mixture of 1-butyl-3-methylimidazolium tetrafluoroborate and 1-butyl-3-methylimidazolium bis(trifluoromethanesulfonyl)imide, a mixture of alkylpyridinium hexafluorophosphate and alkylpyridinium bis(trifluoromethanesulfonyl)imide, a mixture of alkylammonium bis(trifluoromethanesulfonyl)imide and 1-butyl-3-methylimidazolium bis(trifluoromethanesulfonyl)imide, a mixture of 1-butyl-3-methylimidazolium tetrafluoroborate and N,N-diethyl-N-methyl(2-methoxyethyl)ammonium bis(trifluoromethanesulfonyl)imide, a mixture of 1-butyl-3-methylimidazolium hexafluorophosphate and N,N-diethyl-N-methyl(2-methoxyethyl)ammonium bis(trifluoromethanesulfonyl)imide, a mixture of N,N-diethyl-N-methyl(2-methoxyethyl)ammonium bis(trifluoromethanesulfonyl)imide and alkylpyridinium tetrafluoroborate, and a mixture of N,N-diethyl-N-methyl(2-methoxyethyl)ammonium bis(trifluoromethanesulfonyl)imide and alkylpyridinium hexafluorophosphate.

Of these, preferred are a mixture of 1-butyl-3-methylimidazolium tetrafluoroborate and N,N-diethyl-N-methyl(2-methoxyethyl)ammonium bis(trifluoromethanesulfonyl)imide, a mixture of 1-butyl-3-methylimidazolium hexafluorophosphate and N,N-diethyl-N-methyl(2-methoxyethyl)ammonium bis(trifluoromethanesulfonyl)imide, a mixture of N,N-diethyl-N-methyl(2-methoxyethyl)ammonium bis(trifluoromethanesulfonyl)imide and alkylpyridinium tetrafluoroborate, and a mixture of N,N-diethyl-N-methyl(2-methoxyethyl)ammonium bis(trifluoromethanesulfonyl)imide and alkylpyridinium hexafluorophosphate.

Through employment, as a base oil, of an ionic liquid which does not comprise a cation (imidazolium) represented by the following general formula:

[F5]

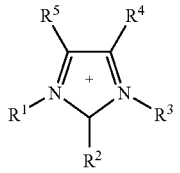

(wherein each of $R^1$ to $R^5$, which may be identical to or different from one another, represents a group selected from among a hydrogen atom, alkyl groups having carbon atoms of 1 to 18 which may each have an ether bond, and alkoxyl groups having carbon atoms of 1 to 18), $F^-$, $Cl^-$, $Br^-$, or $BF_4^-$, a non-toxic and non-corrosive grease composition can be produced. Specific examples of such ionic liquid species include alkylpyridinium hexafluorophosphate, alkylpyridinium bis(trifluoromethanesulfonyl)imide, alkylammonium hexafluorophosphate, alkylammonium bis(trifluoromethanesulfonyl)imide, N,N-diethyl-N-methyl(2-methoxyethyl)ammonium hexafluorophosphate, and N,N-diethyl-N-methyl(2-methoxyethyl)ammonium bis(trifluoromethanesulfonyl)imide.

Of these, alkylpyridinium bis(trifluoromethanesulfonyl)imide, alkylammonium bis(trifluoromethanesulfonyl)imide, and N,N-diethyl-N-methyl(2-methoxyethyl)ammonium bis(trifluoromethanesulfonyl)imide are preferred.

In the present invention, there may be employed as a base oil an ionic liquid formed of a zwitter ion in which a cation and an anion are linked via a covalent bond and having a total acid number of 1 mgKOH/g or less. The grease composition of the present invention has an ionic liquid content of 10 to 100% by mass, preferably 50 to 100% by mass, more preferably 70 to 100% by mass, particularly preferably 90 to 100% by mass.

For example, the ionic liquid is represented by any of the following general formulae:

[F6]

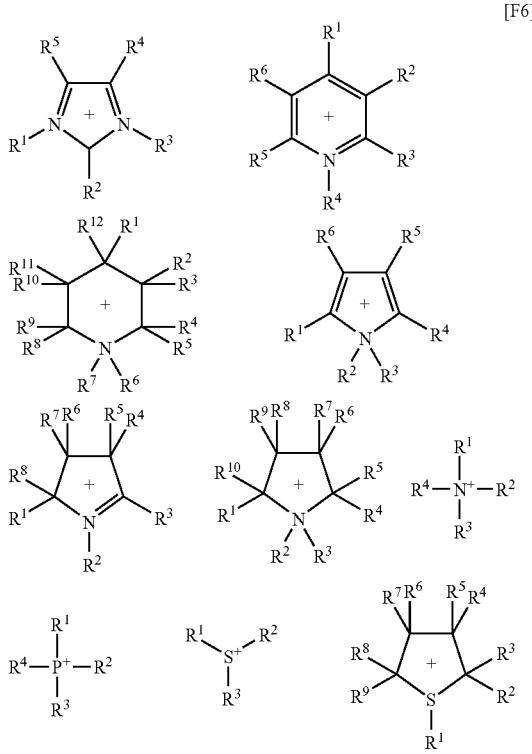

(wherein each of $R^1$ to $R^{12}$, which may be identical to or different from one another, represents a group selected from among a hydrogen atom, alkyl groups having carbon atoms of 1 to 18 which may each have an ether bond, and alkoxyl groups having carbon atoms of 1 to 18; and at least one of $R^1$ to $R^{12}$ is $—(CH_2)_n—SO_3^-$ or $—(CH_2)_n—COO^-$ (wherein n is an integer of 0 or greater such that the number of carbon atoms of each alkyl group falls within a range of 1 to 18)).

Specific examples include 1-methyl-1,3-imidazolium-N-butanesulfonate and N,N-diethyl-N-methylammonium-N-butanesulfonate.

From the viewpoint of corrosion prevention of materials to which the grease composition of the present invention is applied, the aforementioned ionic liquid is required to have a total acid number of 1 mgKOH/g or less, preferably 0.5 mgKOH/g or less, more preferably 0.3 mgKOH/g or less.

From the viewpoint of prevention of vaporization loss and power loss due to viscosity resistance, the aforementioned ionic liquid preferably has a kinematic viscosity, as determined at 40° C., of 1 to 1,000 $mm^2/s$, more preferably 2 to 320 $mm^2/s$, further more preferably 5 to 100 $mm^2/s$.

From the viewpoint of prevention of increase in viscosity resistance at low temperature, the aforementioned ionic liquid preferably has pour point of −10° C. or lower, more preferably −20° C. or lower, further more preferably −30° C. or lower.

From the viewpoint of reduction of vaporization loss of base oil, the aforementioned ionic liquid preferably has a flash point of 200° C. or higher, more preferably 250° C. or higher, further more preferably 300° C. or higher.

In order to prevent excessive increase of temperature-dependent viscosity change, the aforementioned ionic liquid preferably has a viscosity index of 80 or higher, more preferably 100 or higher, further more preferably 120 or higher.

A characteristic feature of the grease composition of the present invention is that the composition comprises a thickener, wherein the grease composition has a dropping point of 260° C. or higher. As used herein, the term "dropping point" refers to a temperature at which a tested grease starts melting and dropping by its self-weight and, in the present invention, is determined in accordance with the method as stipulated in "MS K2220-2003 8." When the thickener has a dropping point of 260° C. or higher, the grease does not liquefy at high temperatures and fully attains its functions. The grease composition preferably has a dropping point of 280° C. or higher, more preferably 300° C. or higher.

No particular limitation is imposed on the type of the thickener employed in the present invention so long as the grease composition has a dropping point of 260° C. or higher. However, non-soap-based thickeners such as urea-based thickeners, fluororesin-based thickeners, inorganic thickeners, and carbon-based thickeners are preferred, since a non-soap-based thickener forms grease more readily than a soap-based thickener and does not readily degrade when exposed to an atmosphere of 250° C. or higher for a long period of time. Thus, non-soap-based thickeners impart well-balanced performance to grease for high-temperature use.

Any of known urea-based thickeners may be employed. Specific examples include diurea compounds, triurea compounds, tetraurea compounds, and urethane-urea compounds.

Examples of fluororesin-based thickeners include polytetrafluoroethylene (PTFE) and trifluoroethylene resin. Of these, polytetrafluoroethylene (PTFE) is preferred.

Examples of inorganic thickeners include silica gel; clay minerals such as montmorillonite and bentonite; and boron nitride. Particularly, an inorganic thickener predominantly comprising a clay mineral having been treated with an organic substance is preferred.

Examples of carbon-based thickeners include graphite; fullerene; carbon black; and carbon nano-substances such as carbon nanotubes, carbon nanocoils, carbon nanowires, and carbon nanohorns.

Other than these thickeners, non-soap-based thickeners such as sodium terephthalamate may also be employed.

From the viewpoint of long-term stability particularly at 250° C. or higher, among the aforementioned non-soap-based thickeners, inorganic thickeners and carbon-based thickeners are preferred.

The grease composition of the preset invention preferably has a thickener content of 3 to 50% by mass. When the content falls within the range, a consistency (cone penetration) which typical grease products exhibit can readily be attained. From the viewpoints mentioned above, the thickener content is more preferably 6 to 25% by mass. The aforementioned thickeners may be used singly or in combination of two or more member.

The grease composition of the present invention may comprise additives so long as the effects of the invention are not impaired. Examples of the additives include antioxidants, oiliness agents, extreme pressure agents, viscosity index improvers, rust preventives, metal deactivators, solid lubricants, and tackifiers. These additive may be used singly or in combination of two or more member.

As antioxidants, amine-based antioxidants, phenol-based antioxidants, and sulfur-based antioxidants, which are employed in conventional grease compositions, may be used.

These antioxidants may be used singly or in combination of two or more member. Examples of the amine-based anti-oxidants include monoalkyldiphenylamines such as monoctyldiphenylamine and monononyldiphenylamine; dialkyldiphenylamines such as 4,4'-dibutyldiphenylamine, 4,4'-dipentyldiphenylamine, 4,4'-dihexyldiphenylamine, 4,4'-diheptyldiphenylamine, 4,4'-dioctyldiphenylamine, and 4,4'-dinonyldiphenylamine; polyalkyldiphenylamines such as tetrabutyldiphenylamine, tetrahexyldiphenylamine, tetraoctyldiphenylamine, and tetranonyldiphenylamine; and naphtylamines such as α-naphthylamine, phenyl-α-naphtylamine, butylphenyl-α-naphtylamine, pentylphenyl-α-naphtylamine, hexylphenyl-α-naphtylamine, heptylphenyl-α-naphtylamine, octylphenyl-α-naphtylamine, and nonylphenyl-α-naphtylamine.

Examples of the phenol-based anti-oxidants include monophenolic anti-oxidants such as 2,6-di-tert-butyl-4-methylphenol and 2,6-di-tert-butyl-4-ethylphenol; and diphenolic anti-oxidants such as 4,4'-methylenebis(2,6-di-tert-butylphenol) and 2,2'-methylenebis(4-ethyl-6-tert-butylphenol).

Examples of the sulfur-based antioxidants include 2,6-di-tert-butyl-4-(4,6-bis(octylthio)-1,3,5-triazin-2-ylamino)phenol; thioterpene compounds such as reaction products between phosphorus pentasulfide and pinene; and dialkylthio dipropionates such as dilaurylthio dipropionate and distearylthio dipropionate.

The antioxidant(s) are generally incorporated in an amount of about 0.01 to 10% by mass based on the total amount of the grease composition, preferably 0.03 to 5% by mass.

Examples of the oiliness agents include fatty acid compounds such as aliphatic alcohols, fatty acids, and fatty acid metal salts; ester compounds such as polyol esters, sorbitan esters, and glycerides; and amine compounds such as aliphatic amines. The aliphatic alcohols are collectively represented by general formula (I):

$$R^{18}—OH \quad (I)$$

(wherein $R^{18}$ represents a group selected from among alkyl groups, alkenyl groups, alkylaryl groups, and arylalkyl groups, each having 8 to 30, preferably 12 to 24 carbon atoms). Examples of the alkyl groups having carbon atoms of 8 to 30 include octyl groups, nonyl groups, decyl groups, undecyl groups, stearyl groups, lauryl groups, and palmityl groups. Examples of the alkenyl groups having carbon atoms of 8 to 30 include octenyl, nonenyl, decenyl, and octadecenyl such as oleyl. Examples of the alkylaryl groups having carbon atoms of 8 to 30 include dimethylphenyl groups, diethylphenyl groups, dipropylphenyl groups, methylnaphthyl groups, and ethylnaphthyl groups. Examples of the arylalkyl groups having carbon atoms of 8 to 30 include phenethyl and nahpthylmethyl. Of these, stearyl and oleyl are preferred.

The fatty acid compounds are collectively represented by general formula (II):

$$(R^{19}—COO)_nX^1 \quad (II)$$

(wherein $R^{19}$ represents a group selected from among alkyl groups, alkenyl groups, alkylaryl groups, and arylalkyl groups, each having 8 to 30, preferably 12 to 24 carbon atoms; $X^1$ represents an atom selected from among H, K, Na, Mg, Ca, Al, Zn, Fe, Cu, and Ag). Examples of each having carbon atoms of 8 to 30 alkyl groups, alkenyl groups, alkylaryl groups, and arylalkyl groups, each forming $R^{19}$, include the same as described above, and stearyl and oleyl are preferred. $X^1$ is preferably H, K, Al, or Zn. The "n" is an integer of 1 to 3.

Examples of the polyol esters include esterification products between a polyhydric alcohol such as neopentyl glycol, trimethylolpropane, or pentaerythritol and a fatty acid represented by general formula (III):

$$R^{20}—COOH \quad (III)$$

(wherein $R^{20}$ represents a group selected from among alkyl groups, alkenyl groups, alkylaryl groups, and arylalkyl groups, each having 8 to 30, preferably 8 to 24 carbon atoms). Examples of the group selected from among alkyl groups, alkenyl groups, alkylaryl groups, and arylalkyl groups, each having 8 to 30 carbon atoms and forming $R^{20}$, include the same as described above, and octyl is particularly preferred.

The sorbitan esters are collectively represented by the following general formula (IV):

[F7]

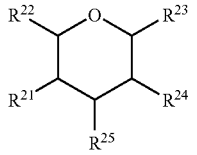

(IV)

(wherein each of $R^{21}$ to $R^{25}$ represents a group selected from H, OH, and $CH_2OCOR^{26}$; $R^{26}$ represents an alkyl or alkenyl group, each having 9 to 30, preferably 12 to 24 carbon atoms).

Examples of the alkyl groups having carbon atoms of 9 to 30 forming $R^{26}$ include nonyl groups, decyl groups, undecyl groups, stearyl groups, lauryl groups, and palmityl groups. Examples of the alkenyl groups having carbon atoms of 9 to 30 include nonenyl, decenyl, and octadecenyl. Examples of preferred fatty acids include lauric acid, stearic acid, palmitic acid, and oleic acid.

The glycerids are collectively represented by the following general formula (V):

[F8]

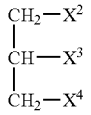

(V)

(wherein each of $X^2$ to $X^4$ represents OH or $OCOR^{27}$; $R^{27}$ represents an alkyl or alkenyl group each having 8 to 30, preferably 12 to 24 carbon atoms).

Examples of the alkyl or alkenyl group having carbon atoms of 8 to 30 forming $R^{27}$ include the same as described above. Examples of preferred fatty acids include lauric acid, stearic acid, palmitic acid, and oleic acid.

Examples of the fatty acid amines include mono-substituted, di-substituted, and tri-substituted amines represented by the following general formula (VI):

$$R^{28}{}_mNH_{3-m} \quad (VI)$$

(wherein $R^{28}$ represents a group selected from among having carbon atoms of 3 to 30 (preferably 8 to 24) alkyl and alkenyl groups, having carbon atoms of 6 to 30 (preferably 6 to 15) aryl and arylalkyl groups, and having carbon atoms of 2 to 30 (preferably 2 to 18) hydroxyalkyl groups; and m is an integer of 1 to 3). Among these groups, the alkyl and alkenyl groups each forming $R^{28}$ may be linear, branched, or cyclic.

Examples of the having carbon atoms of 3 to 30 alkyl and alkenyl groups, and examples of having carbon atoms of 6 to 30 aryl and arylalkyl groups include the same as described above. Examples of the having carbon atoms of 2 to 30 hydroxyalkyl group include hydroxyethyl and hydroxypropyl.

From the effect of incorporation, these oiliness agent(s) are generally incorporated in an amount of about 0.1 to about 30% by mass based on the total amount of the grease composition, preferably 0.5 to 10% by mass.

Examples of the extreme pressure agent include sulfur containing extreme pressure agents, phosphorus containing extreme pressure agents, sulfur and metal containing extreme pressure agents, and phosphorus and metal containing extreme pressure agents. These extreme pressure agents may be used singly or in combination of two or more member. Any extreme pressure agent may be used, so long as the agent contains in the molecule thereof a sulfur atom and/or a phosphorus atom and can exhibit load resistance and wear resistance. Examples of the extreme pressure agent containing a sulfur atom in the molecule thereof include sulfidized fats and oils, sulfidized fatty acid, sulfidized esters, sulfidized olefins, dihydrocarbyl polysulfides, thiadiazole compounds, alkyl thiocarbamoyl compounds, triazine compounds, thioterpene compounds, and dialkyl thiodipropionate compounds.

The sulfidized fats and oils are produced through reaction of a fat or an oil (e.g., lard, whale oil, vegetable oil, or fish oil) with sulfur or a sulfur-containing compound. Although no particular limitation is imposed on the sulfur content, the content preferably 5 to 30% by mass. Specific examples include sulfidized lard, sulfidized rape seed oil, sulfidized castor oil, sulfidized soy-bean oil, and sulfidized rice bran oil. Examples of the sulfidized fatty acids include sulfidized oleic acid. Examples of the sulfidized esters include sulfidized methyl oleate and sulfidized octyl ester of rice bran fatty acid.

Examples of the sulfidized olefins include compounds represented by the following general formula (VII):

$$R^{29}—S_a—R \quad (VII)$$

(wherein $R^{29}$ represents a having carbon atoms of 2 to 15 (preferably 4 to 8) alkenyl group, $R^{30}$ represents a having carbon atoms of 2 to 15 (preferably 4 to 8) alkyl group or alkenyl group; and a is an integer of 1 to 8, preferably 1 to 3). These compounds are produced through reaction between a having carbon atoms of 2 to 15 olefin or a dimer to tetramer thereof and a sulfidizing agent such as sulfur or sulfur chloride. Preferred having carbon atoms of 2 to 15 olefins include propylene, isobutene, and diisobutene.

Examples of the dihydrocarbyl polysulfides include compounds represented by the following general formula (VIII):

$$R^{31}—S_b—R^{32} \quad (VIII)$$

(wherein $R^{31}$ and $R^{32}$, which may be identical to or different from each other, each represent a having carbon atoms of 1 to 20 (preferably 4 to 18) alkyl group or cyclic alkyl group, a having carbon atoms of 6 to 20 (preferably 6 to 15) aryl group, a having carbon atoms of 7 to 20 (preferably 7 to 15) alkyl aryl group, or a having carbon atoms of 7 to 20 (preferably 7 to 15) arylalkyl group; and b is an integer of 2 to 8, preferably 2 to 4). When each of $R^{31}$ and $R^{32}$ is an alkyl group, the compound is called alkyl sulfide.

Examples of the group represented by $R^{31}$ or $R^{32}$ in general formula (VIII) include methyl, ethyl, n-propyl, isopropyl, n-butyl, isobutyl, sec-butyl, tert-butyl, pentyl groups, hexyl groups, heptyl groups, octyl groups, nonyl groups, decyl groups, dodecyl groups, cyclohexyl, cyclooctyl, phenyl, naphthyl, tolyl, xylyl, benzyl, and phenethyl.

Examples of preferred dihydrocarbyl polysulfides include dibenzyl polysulfides, dinonyl polysulfides, dodecyl polysulfides, dibutyl polysulfides, dioctyl polysulfides, diphenyl polysulfides, and dicyclohexyl polysulfides.

Examples of preferably employed thiadiazole compounds include 1,3,4-thiadiazole, 1,2,4-thiadiazole compound, and 1,4,5-thiadiazole represented by the following general formulae (IX) or (X):

[F9]

(IX)

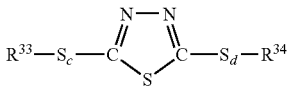

(X)

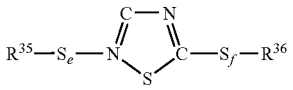

(wherein each of $R^{33}$ to $R^{36}$ represents a hydrogen atom, a having carbon atoms of 1 to 20 (preferably 4 to 13) hydrocarbon group; and each of c to f is an integer of 0 to 8, preferably 1 to 4) Specific examples of preferred thiadiazole compounds include 2,5-bis(n-hexyldithio)-1,3,4-thiadiazole, 2,5-bis(n-octyldithio)-1,3,4-thiadiazole, 2,5-bis(n-nonyldithio)-1,3,4-thiadiazole, 2,5-bis(1,1,3,3-tetramethylbutyldithio)-1,3,4-thiadiazole, 3,5-bis(n-hexyldithio)-1,2,4-thiadiazole, 3,5-bis(n-octyldithio)-1,2,4-thiadiazole, 3,5-bis(n-nonyldithio)-1,2,4-thiadiazole, and 3,5-bis(1,1,3,3-tetramethylbutyldithio)-1,2,4-thiadiazole.

Examples of preferably employed alkyl thiocarbamoyl compounds include compounds represented by the following general formula (XI):

[F10]

(XI)

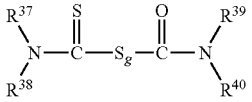

(wherein each of $R^{37}$ to $R^{40}$ represents a having carbon atoms of 1 to 20 (preferably 4 to 8) alkyl group, and g is an integer of 1 to 8, preferably 1 to 3). Specific examples of preferred alkyl thiocarbamoyl compounds include bis(dimethylthiocarbamoyl)monosulfide, bis(dibutylthiocarbamoyl)monosulfide, bis(dimethylthiocarbamoyl)disulfide, bis(dibutylthiocarbamoyl)disulfide, bis(diamylthiocarbamoyl) disulfide, and bis(dioctylthiocarbamoyl) disulfide.

Examples of the extreme pressure agent comprising sulfur or phosphorus with metal include zinc dialkylthiocarbamate (Zn-DTC), molybdenum dialkylthiocarbamate (Mo-DTC), lead dialkylthiocarbamate, tin dialkylthiocarbamate, zinc dialkyldithiophosphate (Zn-DTP), molybdenum dialkyldithiophosphate (Mo-DTP), sodium sulfonate, and calcium sulfonate.

Typical examples of the extreme pressure agent comprising phosphorus in the molecule thereof are phosphate esters and amine salts thereof. The phosphate esters include phosphate esters, acid phosphate esters, phosphite esters, and acid phosphite esters represented by the following general formulae (XII) to (XVI):

[F11]

(XII)

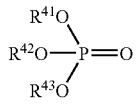

(XIII)

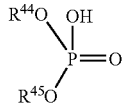

(XIV)

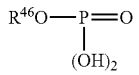

(XV)

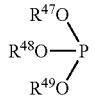

(XVI)

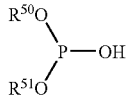

(wherein $R^{41}$ to $R^{51}$, which may be identical to or different from one another, each represent an alkyl group, an alkenyl group, an alkylaryl group, or an arylalkyl group, having 4 to (preferably 4 to 18) carbon atoms).

Examples of the phosphate esters include triaryl phosphates, trialkyl phosphates, trialkylaryl phosphates, triarylalkyl phosphates, and trialkenyl phosphates. Specific examples include triphenyl phosphate, tricresyl phosphate, benzyl diphenyl phosphate, ethyl diphenyl phosphate, tributyl phosphate, ethyl dibutyl phosphate, cresyl diphenyl phosphate, dicresyl phenyl phosphate, ethylphenyl diphenyl phosphate, diethylphenyl phenyl phosphate, propylphenyl diphenyl phosphate, dipropylphenyl phenyl phosphate, triethylphenyl phosphate, tripropylphenyl phosphate, butylphenyl diphenyl phosphate, dibutylphenyl phenyl phosphate, tributylphenyl phosphate, trihexyl phosphate, tri(2-ethylhexyl) phosphate, tridecyl phosphate, trilauryl phosphate, trimyristyl phosphate, tripalmityl phosphate, tristearyl phosphate, and trioleyl phosphate.

Examples of the acid phosphate esters include 2-ethylhexyl acid phosphate, ethyl acid phosphate, butyl acid phosphate, oleyl acid phosphate, tetracosyl acid phosphate, isodecyl acid phosphate, lauryl acid phosphate, tridecyl acid phosphate, stearyl acid phosphate, and isostearyl acid phosphate.

Examples of the phosphite esters include triethyl phosphite, tributyl phosphite, triphenyl phosphite, tricresyl phosphite, tri(nonylphenyl) phosphite, tri(2-ethylhexyl) phosphite, tridecyl phosphite, trilauryl phosphite, triisooctyl phosphite, diphenyl isodecyl phosphite, tristearyl phosphite, and trioleyl phosphite.

Examples of the acid phosphite esters include dibutyl hydrogen phosphite, dilauryl hydrogen phosphite, dioleyl hydrogen phosphite, distearyl hydrogen phosphite, and diphenyl hydrogen phosphite. Examples of the amines which form amine salts with the acid phosphite esters include monosubstituted amines, disubstituted amines, and trisubstituted amines, which are represented by general formula (XVII):

$$R^{52}{}_{h}NH_{3-h} \quad \text{(XVII)}$$

(wherein $R^{52}$ represents a having carbon atoms of 3 to 30 (preferably 4 to 18) alkyl group or alkenyl group, a having carbon atoms of 6 to 30 (preferably 6 to 15) aryl group or arylalkyl group, or a having carbon atoms of 2 to 30 (preferably 2 to 18) hydroxyalkyl group; h is 1, 2, or 3; when a plurality of $R^{52}$s are present, these $R^{52}$s may be identical to or different from one another). The having carbon atoms of 3 to 30 alkyl or alkenyl group represented by $R^{52}$ in the above general formula (XVII) may be linear, branched, or cyclic.

Examples of the monosubstituted amines include butylamine, pentylamine, hexylamine, cyclohexylamine, octylamine, laurylamine, stearylamine, oleylamine, and benzylamine. Examples of the disubstituted amines include dibutylamine, dipentylamine, dihexylamine, dicyclohexylamine, dioctylamine, dilaurylamine, distearylamine, dioleylamine, dibenzylamine, stearylmonoethanolamine, decylmonoethanolamine, hexylmonopropanolamine, benzylmonoethanolamine, phenylmonoethanolamine, and tolylmonopropanolamine. Examples of the trisubstituted amines include tributylamine, tripentyl amine, trihexylamine, tricyclohexylamine, trioctylamine, trilaurylamine, tristearylamine, trioleylamine, tribenzylamine, dioleylmonoethanolamine, dilaurylmonopropanolamine, dioctylmonoethanolamine, dihexylmonopropanolamine, dibutylmonopropaolamine, oleyldiethanolamine, stearyldipropanolamine, lauryldiethanolamine, octyldipropanolamine, butyldiethanolamine, benzyldiethanolamine, phenyldiethanolamine, tolyldipronanolamine, xylyldiethanolamine, triethanolamine, and tripropanolamine.

From the viewpoint of the effect of addition and cost, these extreme pressure agent(s) may be incorporated generally in an amount of about 0.01 to about 30% by mass based on the total amount of the grease composition, more preferably 0.01 to 10% by mass.

Examples of the viscosity index improver include polymethacrylates, dispersion-type polymethacrylates, olefin copolymers (e.g., ethylene-propylene copolymer), dispersion-type olefin copolymers, and styrene copolymers (e.g., styrene-diene hydrogenated copolymer).

From the viewpoint of the effect of addition, the viscosity index improver(s) are preferably incorporated generally in an amount of about 0.5 to about 35% by mass based on the total amount of the grease composition, preferably 1 to 15% by mass.

Examples of rust preventives include metal sulfonates and succinate esters. From the viewpoint of the effect of addition, the rust preventive(s) are incorporated generally in an amount of about 0.01 to about 10% by mass based on the total amount of the grease composition, preferably 0.05 to 5% by mass.

Examples of the metal deactivator include benzotriazoles and thiadiazoles. From the viewpoint of the effect of addition, the metal deactivator(s) are preferably incorporated generally in an amount of about 0.01 to about 10% by mass based on the total amount of the grease composition, preferably 0.01 to 1% by mass.

Examples of the solid lubricant include molybdenum disulfide, graphite, copper, nickel, boron nitride, melamine cyanurate. The solid lubricant(s) are preferably incorporated generally in an amount of about 0.1 to about 60% by mass based on the total amount of the grease composition, preferably 0.3 to 30% by mass.

Examples of the tackifier include polybutene, polymethacrylates, dispersion-type polymethacrylates, olefin polymers, dispersion-type olefin polymers, and thermoplastic elastomers. The tackifier(s) is(are) preferably incorporated generally in an amount of about 0.1 to about 30% by mass based on the total amount of the grease composition.

The grease composition of the present invention may employ an additional base oil in combination, so long as the effects of the invention are not impaired. The additional base oil may be appropriately selected from mineral oils and synthetic oils. Examples of the mineral oils include distillates obtained through distillation under normal pressure of paraffin base crude, intermediate base crude, or naphthene base crude; distillates obtained through distillation under reduced pressure of normal-pressure distillation residue; and refined oils obtained from the distillates through a routine refining process. Specific examples include solvent-refined oil, hydro-refined oil, dewaxed oil, and clay-treated oil.

Examples of the synthetic oils include low-molecular-weight polybutene, low-molecular-weight polypropylene, having carbon atoms of 8 to 14 α-olefin oligomers, and hydrogenated products thereof; ester compounds such as polyol esters (e.g., trimethylolpropane fatty acid esters and pentaerythritol fatty acid esters), dibasic acid esters, aromatic polypropylenecarboxylic acid esters (e.g., trimellitic acid esters and pyromellitic acid esters), and phosphate esters; alkyl aromatic compounds such as alkylbenzenes and alkylnaphthalenes; silicone oils; polyphenyl; alkyl-substituted diphenyl ethers; polyphenyl ethers; phosphazene compounds; and fluoro-oils (e.g., fluorocarbon and perfluoropolyether).

These additional base oils may be used singly or in combination of two or more member.

In order to prevent drop in viscosity and corrosion, the grease composition of the present invention preferably has a water content of 3,000 ppm by mass or less based on the amount of the grease composition, more preferably 500 ppm by mass or less, particularly preferably 100 ppm by mass or less. Use of non-aqueous ionic liquid is preferred so as to adjust the water content of the grease composition to 500 ppm by mass.

Through employment of electrical properties of the ionic liquid contained in the grease composition of the present invention, cations and anions can be intentionally adsorbed on a friction surface through application of an electric field to the grease composition, thereby forming a lubricating film. The lubricating film enables controlling of characteristics such as friction characteristics.

No particular limitation is imposed on the way of electric field application. For example, there may be employed method (1) including filling a friction site with a grease composition, the friction site being provided between two friction members sliding relative to each other, disposing electrodes in a non-contact manner such that the friction site intervenes therebetween, and applying voltage to the grease composition, and method (2) including filling a friction site with a grease composition, the friction site being provided between two friction members made of conductive material and sliding relative to each other, and applying voltage directly to the two friction members. From the viewpoint of safety, cost, and the effect of application, applied voltage is generally about 0.1 to about $5\times10^6$ mV, preferably 0.1 to $5\times10^3$ mV, more preferably 0.1 to 100 mV. The applied voltage may be DC or AC.

EXAMPLES

The present invention will next be described in detail by way of examples, which should not be construed as limiting the invention thereto. Properties of each grease composition were determined as follows.

(1) Cone penetration No.: Classified in accordance with Table 1 in JIS K2220-2003.

(2) Dropping point: Determined in accordance with a test method as stipulated in JIS K2220-2003-8.

(3) Appearance: An SPCC steel sheet for "JIS K2220-2003 21." (wetting test) was washed with a solvent, and a grease composition was applied onto the sheet in a thickness of 2.0 mm. The sheet was heated to 150° C. or 300° C. Immediately after heating, whether or not the grease composition could maintain the consistency of grease (semi-solid state) was evaluated. When the grease was maintained its consistency, the word "grease" is given, whereas when not, the word is "liquid" is given.

(4) Long-term high-temperature stability: An SPCC steel sheet for JIS K2220-2003-21. (wetting test) was washed with a solvent, and a grease composition was applied onto the sheet in a thickness of 2.0 mm. The sheet was heated at 250° C. for 12 hours, and the condition of grease was evaluated. The evaluation criteria employed were the grease composition maintained its grease consistency and whether is was solidified.

(5) 5%-Decrease temperature: Determined by means of a differential scanning thermoanalyzer. A grease composition was heated at 10° C./min, and the temperature at which the mass of the composition was reduced by 5% by mass (based on the initial mass) was determined. The higher the 5%-decrease temperature, the more excellent the resistance to vaporization and heat.

Examples 1 to 7 and Comparative Examples 1 to 6

Grease compositions general formulated as shown in Table 1 were prepared, and the aforementioned properties thereof were determined. The results are also shown in Table 1.

TABLE 1

| | | Examples | | | | | | |
|---|---|---|---|---|---|---|---|---|
| | | 1 | 2 | 3 | 4 | 5 | 6 | 7 |
| Base oils | Ionic liquid 1*[1] | 82 | 82 | 81 | 83 | 87 | — | — |
| | Ionic liquid 2*[2] | — | — | — | — | — | 81 | 41.5 |
| | Ionic liquid 3*[3] | — | — | — | — | — | — | 41.5 |
| | Polyα-olefin*[4] | — | — | — | — | — | — | — |
| | PFAE*[5] | — | — | — | — | — | — | — |
| | Aromatic ester*[6] | — | — | — | — | — | — | — |
| Additive | Antioxidant*[7] | — | — | — | — | — | — | — |
| Thickener | Bentonite*[8] | 18 | — | — | — | — | 19 | 17 |
| | Carbon nano-substance*[9] | — | 18 | — | — | — | — | — |
| | Graphite*[10] | — | — | 19 | | — | — | — |
| | Silica gel*[11] | — | — | — | 17 | — | — | — |
| | Diurea*[12] | — | — | — | — | 13 | — | — |
| | Lithium soap*[13] | — | — | — | — | — | — | — |
| | PTFE*[14] | — | — | — | — | — | — | — |

TABLE 1-continued

| | | | | | | | | |
|---|---|---|---|---|---|---|---|---|
| Base oil kinematic viscosity (40° C.) | | 27.1 | 27.1 | 27.1 | 27.1 | 27.1 | 22.4 | 38.7 |
| Base oil viscosity index | | 114 | 114 | 114 | 114 | 114 | 160 | 143 |
| Base oil flash point (° C.) | | 300< | 300< | 300< | 300< | 300< | 300< | 300< |
| Base oil pour point (° C.) | | −30 | −30 | −30 | −30 | −30 | −20 | −45 |
| Evaluation | Cone penetration No. | No. 1 | No. 1 | No. 1 | No. 1 | No. 1 | No. 1 | No. 1 |
| | Dropping point of grease composition(° C.) | 300≦ | 300≦ | 300≦ | 300≦ | 300≦ | 300≦ | 300≦ |
| | Appearance (150° C.) | Grease | Grease | Grease | Grease | Grease | Grease | Grease |
| | Appearance (300° C.) | Grease | Grease | Grease | Grease | Grease | Grease | Grease |
| | Long-term high-temp. stability | Grease | — | — | — | — | Grease | Grease |
| | 5%-Mass decrease temp. (° C.) | 360.5 | — | — | — | — | 409.9 | 402.7 |

| | | Comparative Examples | | | | | |
|---|---|---|---|---|---|---|---|
| | | 1 | 2 | 3 | 4 | 5 | 6 |
| Base oils | Ionic liquid 1*[1] | 89 | 89 | — | — | — | — |
| | Ionic liquid 2*[2] | — | — | — | — | — | — |
| | Ionic liquid 3*[3] | — | — | — | — | — | — |
| | Polyα-olefin*[4] | — | — | 82 | 81 | — | — |
| | PFAE*[5] | — | — | — | — | 83 | — |
| | Aromatic ester*[6] | — | — | — | — | — | 81 |
| Additive | Antioxidant*[7] | — | — | — | 1 | — | 1 |
| Thickener | Bentonite*[8] | — | — | 18 | 18 | — | 18 |
| | Carbon nano-substance*[9] | — | — | — | — | — | — |
| | Graphite*[10] | — | — | — | — | — | — |
| | Silica gel*[11] | — | — | — | 17 | — | — |
| | Diurea*[12] | 11 | — | — | — | — | — |
| | Lithium soap*[13] | — | 11 | — | — | — | — |
| | PTFE*[14] | — | — | — | — | 17 | — |
| Base oil kinematic viscosity (40° C.) | | 27.1 | 27.1 | 16.8 | 17.3 | 17.0 | 40.2 |
| Base oil viscosity index | | 114 | 114 | 124 | 130 | 253 | 137 |
| Base oil flash point (° C.) | | 300< | 300< | 215 | 215 | 300< | 291 |
| Base oil pour point (° C.) | | −30 | −30 | −50> | −50> | −50> | −50> |
| Evaluation | Cone penetration No. | No. 1 | No. 1 | No. 1 | No. 1 | No. 1 | No. 1 |
| | Dropping point of grease composition (° C.) | 248 | 206 | 300≦ | 300≦ | 300≦ | 300≦ |
| | Appearance (150° C.) | Grease | Grease | Grease | Grease | Grease | Grease |
| | Appearance (300° C.) | Liquid | Liquid | Grease | Grease | Grease | Grease |
| | Long-term high-temp. stability | — | — | Solidified | Solidified | Grease | Solidified |
| | 5%-Mass decrease temp. (° C.) | — | — | 231.5 | 245.2 | 226.0 | 304.9 |

(Note)

*[1]Ionic liquid 1: N,N-Diethyl-N-methyl(2-methoxyethyl)ammonium bis(trifluoromethanesulfonyl)imide

*[2]Ionic liquid 2: Butylpyridinium bis(trifluoromethanesulfonyl)imide

*[3]Ionic liquid 3: N,N-Diethyl-N-methyl(2-methoxyethyl)ammonium bistetrafluoroborate

*[4]Polyα-olefin: 1-Decene oligomer

*[5]PFAE: Perfluoroalkyl polyether (Fomblin MO3, product of Solvat Solexis)

*[6]Aromatic ester: Tri(n-octyl) trimellitate

*[7]Antioxidant: 4,4-Dibutyldiphenylamine

*[8]Bentonite: Benton 27, product of NL Industries Inc.

*[9]Carbon nano-substance: Carbon nanotube powder (single-wall carbon nanotubes, L-SWNT (grade), product of New Metals & Chemicals Corporation

*[10]Graphite: "SLA1255," product of Acheson (Japan) Ltd.

*[11]Silica gel: Aerosil 200, product of Nippon Aerosil Co., Ltd.

*[12]Diurea: Reaction product between aliphatic amine and diphenylmethane diisocyanate (MDI)

*[13]Lithium soap: Li 12-hydroxystearate

*[14]PTFE: Polytetrafluoroethylene, primary particle diameter: 0.15 μm

INDUSTRIAL APPLICABILITY

Since the grease composition of the present invention exhibits a long service life when used under high-temperature conditions, and is considerably low-evaporative and incombustible, excellent lubricity can be provided under severe conditions, thereby satisfying demand for maintenance free operation. The grease composition can be suitably employed in electronic parts and devices as well as in production facilities therefor, to which contamination by grease decomposition products is problematic.

The invention claimed is:

1. A grease composition comprising, as a base oil, 50 to 100% mass of the base oil of an ionic liquid formed of a cation and an anion and having an ion concentration of 1 mol/dm$^3$ or more as measured at 20° C., and a thickener, wherein the grease composition has a dropping point of 260° C. or higher, and wherein the ionic liquid is at least one selected from the group consisting of 1-butyl-3-methylimidazolium tetrafluoroborate, 1-butyl-3-methylimidazolium hexafluoroborate, 1-butyl-3-methylimidazolium bis(trifluoromethanesulfonyl)imide, alkylpyridinium tetrafluoroborate, alkylpyridinium hexafluorophosphate, alkylpyridinium bis(trifluoromethanesulfonyl) imide, alkylammonium tetrafluoroborate, alkylammonium hexafluorophosphate, alkylammonium bis (trifluoromethanesulfonyl)imide, N,N-diethyl-N-methyl(2-methoxyethyl)ammonium tetrafluoroborate, N,N-diethyl-N-methyl(2-methoxyethyl)ammonium hexafluorophosphate, N,N-diethyl-N-methyl(2-methoxyethyl)ammonium bis(trifluoromethanesulfonyl) imide, and N,N-diethyl-N-methyl(2-methoxyethyl)ammonium bistetrafluoroborate.

2. The grease composition as described in claim 1, wherein the ionic liquid has a total acid number of 1 mgKOH/g or less.

3. A grease composition comprising, as a base oil, 50 to 100% mass of the base oil of an ionic liquid formed of a cation and an anion and having an ion concentration of 1 mol/dm$^3$ or more as measured at 20° C., and a thickener, wherein the grease composition has a dropping point of 260° C. or higher, and wherein the ionic liquid comprises no cations represented by the following formulae:

[F6]

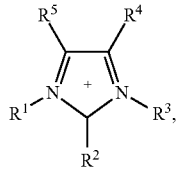

wherein each of $R^1$ to $R^5$, which may be identical to or different from one another, is a group selected from among a hydrogen atom, alkyl groups having carbon atoms of 1 to 18 which may each have an ether bond, and alkoxyl groups having carbon atoms of 1 to 18, $F^-$, $Cl^-$, $Br^-$, or $BF_4^-$.

4. The grease composition as described in claim 3, wherein the ionic liquid is represented by the following formula:

$$(Z^{p+})_k(A^{q-})_m,$$

wherein $Z^{p+}$ represents a cation; $A^{q-}$ represents an anion; each of p, q, k, m, p×k, and q×m is an integer of 1 to 3, with the relationship p×k=q×m being satisfied; and, when k or m is 2 or more, a plurality of Zs or a plurality of As may be identical to or different from each other.

5. The grease composition as described in claim 3, wherein the ionic liquid is represented by the formula $Z^+A^-$, wherein $Z^+$ represents a cation and $A^-$ represents an anion, and having a total acid number of 1 mgKOH/g or less.

6. The grease composition as described in claim 5, wherein the anion ($A^-$) forming the ionic liquid is selected from among $BF_4^-$, $PF_6^-$, $C_nH_{(2n+1)}OSO_3^-$, $(C_nF_{(2n+1-x)}H_x)SO_3^-$, $(C_nF_{(2n+1-x)}H_x)COO^-$, $NO_3^-$, $CH_3SO_3^-$, $(CN)_2N^-$, $HSO_3^-$, $C_6H_5SO_3^-$, $CH_3(C_6H_4)SO_3^-$, $I^-$, $I_3^-$, $F(HF)_n^-$, $((C_nF_{2n+1-x})H_x)Y^1O_z)_3C^-$, $((C_nF_{(2n+1-x)}H_x)Y^1O_z)_2N^-$ wherein $Y^1$ represents a carbon atom or a sulfur atom; when a plurality of $Y^1$s are present, $Ys^1$ may be identical to or different from one another; a plurality of $(C_nF_{(2n+1-x)}H_x)Y^1O_z$ may be identical to or different from one another; n is an integer of 1 to 6; x is an integer of 0 to 13; and z is an integer of 1 to 3 when $Y^1$ is a carbon atom and of 0 to 4 when $Y^1$ is a sulfur atom, $B(C_mY^2_{(2m+1)})_4^-$, $P(C_mY^2_{(2m+1)})_6^-$, wherein $Y^2$ is a hydrogen atom or a fluorine atom; when a plurality of $Y^2$s are present, $Ys^2$ may be identical to or different from one another; a plurality of $(C_mY^2_{(2m+1)})$ may be identical to or different from one another; and m is an integer of 0 to 6, and anions represented by the following formula:

[F3]

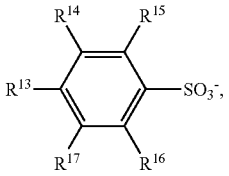

wherein each of $R^{13}$ to $R^{17}$, which may be identical to or different from one another, is a group selected from a hydrogen atom and $(C_nF_{(2n+1-x)}H_x)$; and n is an integer of 1 to 6; x is an integer of 0 to 13.

7. The grease composition as described in claim 6, wherein the anion ($A^-$) forming the ionic liquid is selected from among $PF_6^-$, $C_nH_{(2n+1)}OSO_3^-$, $(C_nF_{(2n+1-x)}H_x)SO_3^-$, $(C_nF_{(2n+1-x)}H_x)COO^-$, $NO_3^-$, $CH_3^-$, $(CN)_2N^-$, $HSO_3^-$, $((C_nF_{(2n+1-x)}H_x)Y^1O_z)_2N^-$, wherein $Y^1$ represents a carbon atom or a sulfur atom; when a plurality of $Y^1$s are present, $Ys^1$ may be identical to or different from one another; n is an integer of 1 to 6; x is an integer of 0 to 13; and z is an integer of 1 to 3 when $Y^1$ is a carbon atom and of 0 to 4 when $Y^1$ is a sulfur atom, and anions represented by the following formula:

[F4]

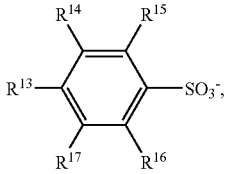

wherein each of $R^{13}$ to $R^{17}$, which may be identical to or different from one another, is a group selected from a hydrogen atom and $(C_nF_{(2n+1-x)}H_x)$; and n is an integer of 1 to 6; x is an integer of 0 to 13.

8. The grease composition as described in claim 7, wherein the anion ($A^-$) forming the ionic liquid is selected from among $C_nH_{(2n+1)}OSO_3^-$, $(C_nF_{(2n+1-x)}H_x)SO_3^-$, $(C_nF_{(2n+1-x)}H_x)COO^-$, $NO_3^-$, $CH_3SO_3^-$, $(CN)_2N^-$, $HSO_3^-$, wherein n is an integer of 1 to 6; and x is an integer of 0 to 13, and anions represented by the following formula:

[F5]

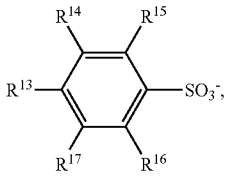

wherein each of $R^{13}$ to $R^{17}$, which may be identical to or different from one another, is a group selected from a hydrogen atom and $(C_nF_{(2n+1-x)}H_x)$; and n is an integer of 1 to 6; x is an integer of 0 to 13.

9. The grease composition as described in claim 3, which is a mixture of two or more ionic liquid species.

10. The grease composition as described in claim 9, wherein the mixture is a mixture comprising one $Z^+$ member and two or more $A^-$ members, a mixture comprising two or more $Z^+$ and one $A^-$ member, or a mixture comprising two or more $Z^+$ members and two or more $A^-$ members.

11. The grease composition as described in claim 3, wherein the cation ($Z^+$) forming the ionic liquid is selected from among cations represented by any of the following formulae:

[F2]

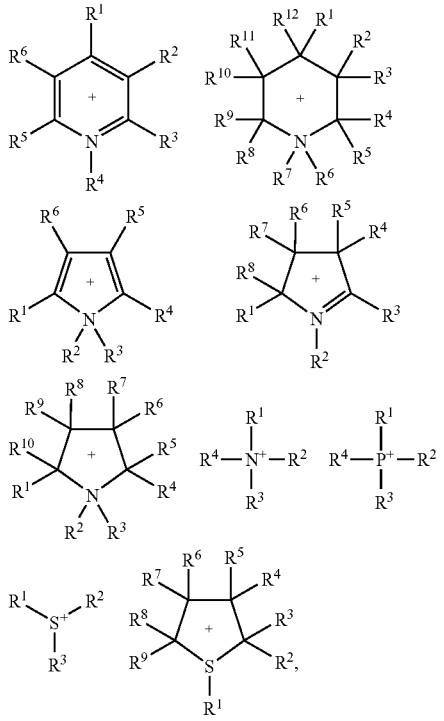

wherein each of $R^1$ to $R^{12}$, which may be identical to or different from one another, is a group selected from among a hydrogen atom, alkyl groups having carbon atoms of 1 to 18 which may each have an ether bond, and alkoxyl groups having carbon atoms of 1 to 18.

12. The grease composition as described in claim 1, wherein the ionic liquid has a kinematic viscosity, as determined at 40° C., of 1 to 1,000 $mm^2/s$.

13. The grease composition as described in claim 1, wherein the ionic liquid has pour point of −10° C. or lower.

14. The grease composition as described in claim 1, wherein the ionic liquid has a viscosity index of 80 or more.

15. The grease composition as described in claim 1, wherein the ionic liquid has a flash point of 200° C. or higher.

16. The grease composition as described in claim 1, wherein the thickener is a non-soap-based thickener.

17. The grease composition as described in claim 16, wherein the thickener is an inorganic thickener and/or a carbon-based thickener.

18. The grease composition as described in claim 1, wherein the thickener in present an amount of 3 to 50% by mass based on the total amount of the composition.

19. The grease composition as described in claim 1, wherein the base oil comprises 70 to 100% by mass of the ionic liquid.

20. The grease composition as described in claim 1, wherein the base oil comprises 90 to 100% by mass of the ionic liquid.

21. A grease composition comprising, as a base oil, an ionic liquid formed of a zwitter ion in which a cation and an anion are linked via a covalent bond and having a total acid number of 1 mgKOH/g or less, in an amount of 50 to 100% by mass of the base oil, wherein the base oil is the base oil according to claim 1.

22. A grease composition comprising, as a base oil, an ionic liquid formed of a zwitter ion in which a cation and an anion are linked via a covalent bond and having a total acid number of 1 mgKOH/g or less, in an amount of 50 to 100% by mass of the base oil.

23. The grease composition as described in claim 22, wherein the ionic liquid is represented by any of the following formulae:

[F7]

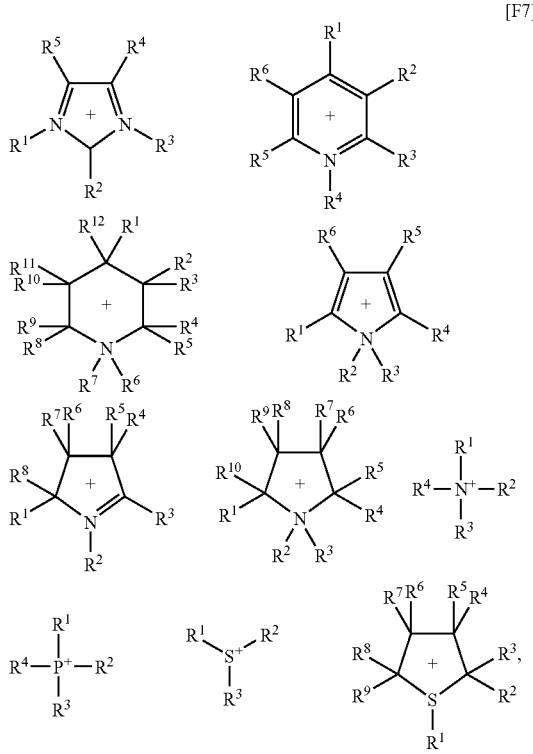

wherein each of $R^1$ to $R^{12}$, which may be identical to or different from one another, is a group selected from among a hydrogen atom, alkyl groups having carbon atoms of 1 to 18 which may each have an ether bond, and alkoxyl groups having carbon atoms of 1 to 18; and at least one of $R^1$ to $R^{12}$ is $—(CH_2)_n—SO_3^-$ or $—(CH_2)_n—COO^-$, wherein n is an integer of 0 or greater such that the number of carbon atoms of each alkyl group falls within a range of 1 to 18.

24. The grease composition as described in claim 22, wherein the base oil comprises 70 to 100% by mass of the ionic liquid.

25. The grease composition as described in claim 22, wherein the base oil comprises 90 to 100% by mass of the ionic liquid.

* * * * *